US006457571B1

(12) United States Patent
Chen

(10) Patent No.: US 6,457,571 B1
(45) Date of Patent: Oct. 1, 2002

(54) PROTECTIVE STRAP FOR SUITCASE

(76) Inventor: Sheng Chin Chen, No. 59, Herng Jun Street, Da Gia Town, Taichung Hsien 437 (TW)

( * ) Notice: Subject to any disclaimer, the term of this patent is extended or adjusted under 35 U.S.C. 154(b) by 0 days.

(21) Appl. No.: 09/659,032

(22) Filed: Sep. 11, 2000

(51) Int. Cl.[7] ..... A45C 13/36
(52) U.S. Cl. ..... 190/37; 224/261
(58) Field of Search ..... 190/37, 126, 127; D3/322, 318, 321; 224/261, 633; 16/114.1, 411, 902, DIG. 19

(56) References Cited

U.S. PATENT DOCUMENTS 798,531 A 8/1905 Riecke
922,567 A 5/1909 Cosgrove
1,583,270 A * 5/1926 Bessee ..... 16/111
4,383,142 A * 5/1983 Kaneko ..... 190/49
4,416,166 A * 11/1983 Jannard et al. ..... 74/551.9
RE32,747 E * 9/1988 Ullmann et al. ..... 200/157
5,261,665 A * 11/1993 Downey ..... 237/81 B
6,035,982 A * 3/2000 Wei-Chih ..... 190/37
D442,784 S * 5/2001 Chen ..... D3/322
6,290,039 B1 * 9/2001 Chen ..... 190/37

* cited by examiner

*Primary Examiner*—Lee Young
*Assistant Examiner*—Lien Ngo
(74) *Attorney, Agent, or Firm*—Charles E. Baxley

(57) ABSTRACT

A protective strap includes a longitudinal or tubular member for securing onto and for protecting the suitcase and having a bore and having one or more orifices formed in the outer peripheral portion and communicating with the bore of the body. A tubular insert is received in the bore of the tubular member and includes one or more projections engaged in the orifices of the tubular member. The orifices of the tubular member and the projections of the insert may be made into various kinds of shapes and colors for decorative purposes.

4 Claims, 4 Drawing Sheets

PROTECTIVE STRAP FOR SUITCASE

BACKGROUND OF THE INVENTION

1. Field of the Invention

The present invention relates to a strap, and more particularly to a protective strap for attaching to and for protecting the peripheral portion of the suitcase or the like.

2. Description of the Prior Art

Typical suitcases, handbags, etc., comprise eight corners and/or twelve sides or edges that are required to be reinforced or protected. For example, U.S. Pat. No. 798,531 to Rieche, and U.S. Pat. No. 922,567 to Cosgrove discloses the suitcases having the protective corner members attached to the corners for reinforcing or for protecting the suitcases. The corner members are normally made of metal and may not be attached to the flexible handbags.

The present invention has arisen to mitigate and/or obviate the afore-described disadvantages of the conventional protective members for suitcases.

SUMMARY OF THE INVENTION

The primary objective of the present invention is to provide a protective strap for attaching to and for protecting the peripheral portions and/or the corners of the suitcase or the like and for reinforcing or protecting the suitcases and for preventing the peripheral portions and/or the corner areas of the suitcase from being damaged by the other objects.

In accordance with one aspect of the invention. there is provided a protective strap for a suitcase and the like, the protective strap comprising a body member for attaching onto the suitcase by such as the stitches or by fasteners or by adhesive materials or by welding processes, the body member including a bore formed therein and including an outer peripheral portion having at least one orifice formed therein and communicating with the bore of the body, and an insert received in the bore of the body member, the insert including at least one projection extended therefrom and engaged in the orifice of the body member. The body member and/or the insert and/or the projections of the insert may be formed into various kinds of shapes and/or colors for decorative purposes.

The orifice of the body member includes a depth equal to or greater than or smaller than a thickness of the projection of the insert. The projection of the insert includes a shape corresponding to that of the orifice of the body member for engaging into the orifice of the body member.

The body member includes a longitudinal portion having a pair of longitudinal flaps extended laterally therefrom and includes a channel defined between the longitudinal flaps and communicating with the bore of the body member. The longitudinal flaps of the body member each includes a plurality of teeth formed therein. The longitudinal flaps of the body member may be secured to the suitcase by such as the stitches or by fasteners or by adhesive materials or by welding processes.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
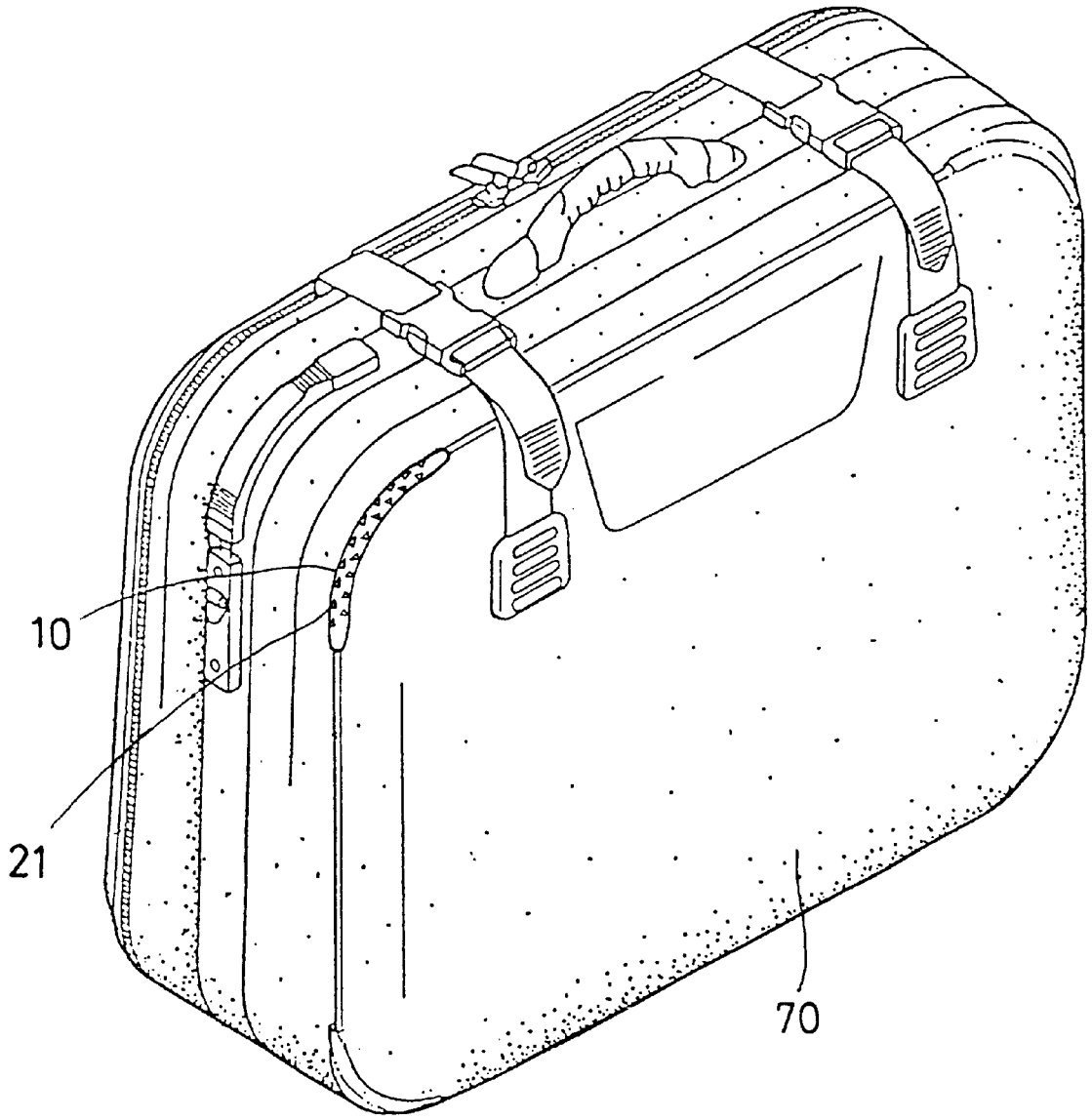
FIG. 1 is a perspective view of a suitcase having a protective strap in accordance with the present invention.
Figure 2:
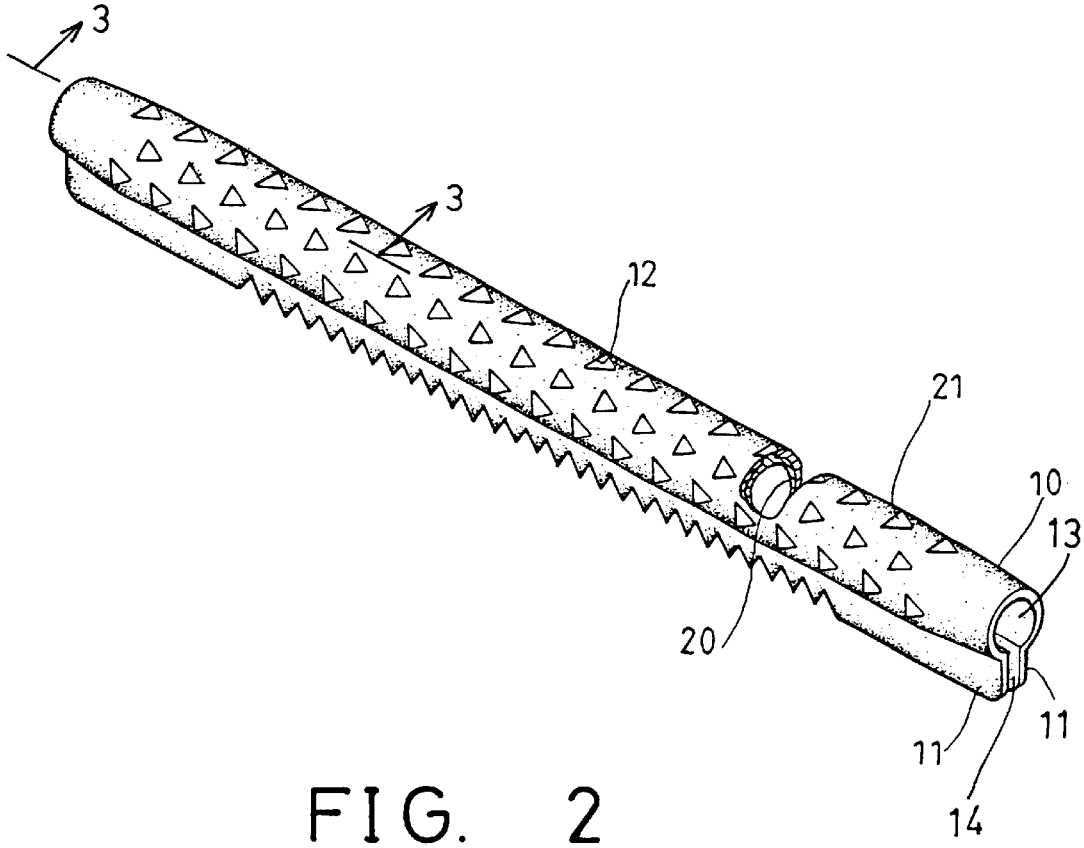
FIG. 2 is a perspective view of the protective strap.
Figure 3:
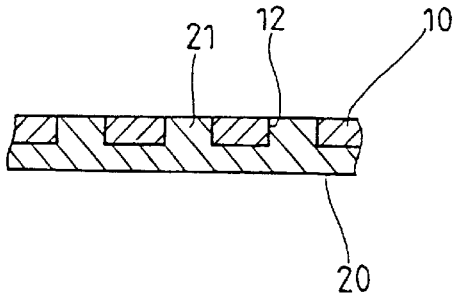
FIG. 3 is a cross sectional view taken along lines 3—3 of FIG. 2.

Referring to the drawings, and initially to FIGS. 1–3, a protective strap in accordance with the present invention comprises a longitudinal or tubular body member 10 for attaching onto the peripheral portions and/or the corner areas of the suitcase 70 or the like and for reinforcing or protecting the suitcases from being damaged. The tubular body member 10 includes a bore 13 formed therein and includes a pair of longitudinal flaps 11 extended laterally from the longitudinal portion thereof and includes a channel 14 formed or defined between the longitudinal flaps 11 and communicating with the bore 13 of the tubular body member 10. The longitudinal flaps 11 of the tubular body member .10 may be secured to the peripheral portions and/or the corner areas of the suitcase 70 by stitches, fasteners, adhesive materials, or by welding processes. The flaps 11 may each include a number of teeth 17 formed thereon for decorative purposes. The tubular body member 10 includes one or more orifices 12 formed therein, particularly formed in the outer peripheral portion thereof and communicating with the bore 13 of the tubular body member 10. The orifices 12 may be formed into various kinds of shapes, such as the geometric figures including triangle, rectangle or square etc., animal figures, or the other marks, etc.

A tubular insert 20 is engaged in the tubular body member 10, best shown in FIG. 2, and has a shape similar to or corresponding to that of the inner peripheral portion of the tubular body member 10. The tubular insert 20 may be solidly engaged in the inner portion of the tubular body member 10 with a molding process, for example. The tubular body member 10 and the tubular insert 20 may also be simultaneously formed by a molding or injecting process. The tubular insert 20 includes one or more projections 21 extended therefrom and having a shape similar to that of the orifices 12 of the tubular body member 10, such that the projections 21 of the tubular insert 20 may be solidly engaged in the orifices 12 of the tubular body member 10 respectively.

Figure 4:
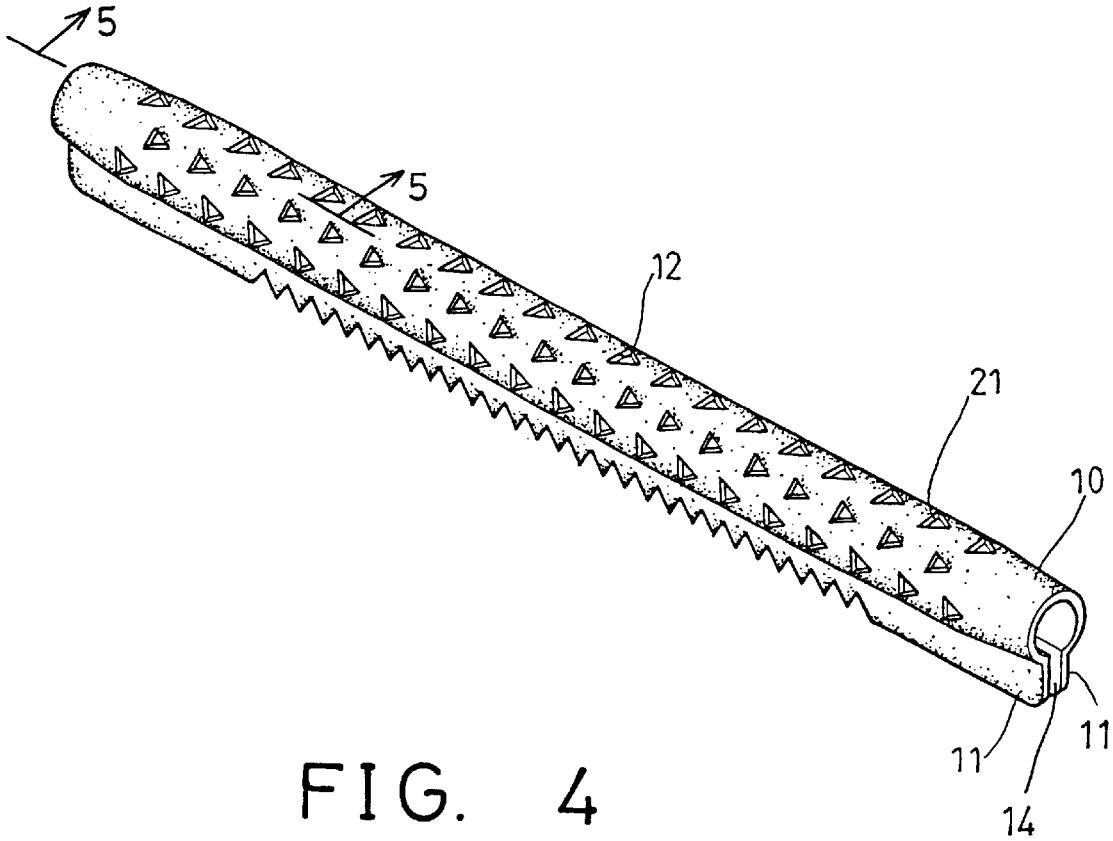
FIGS. 4 and 6 are perspective views illustrating the other applications of the protective strap.
Figure 5:
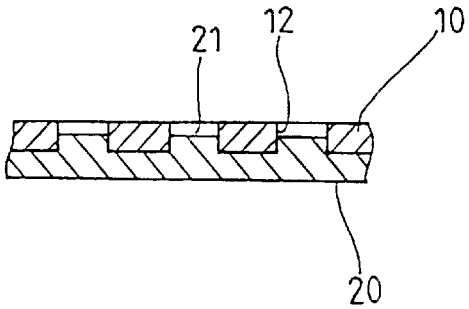
FIGS. 5 and 7 are cross sectional views taken along lines 5—5 and 7—7 of FIGS. 4 and 6 respectively.
Figure 6:
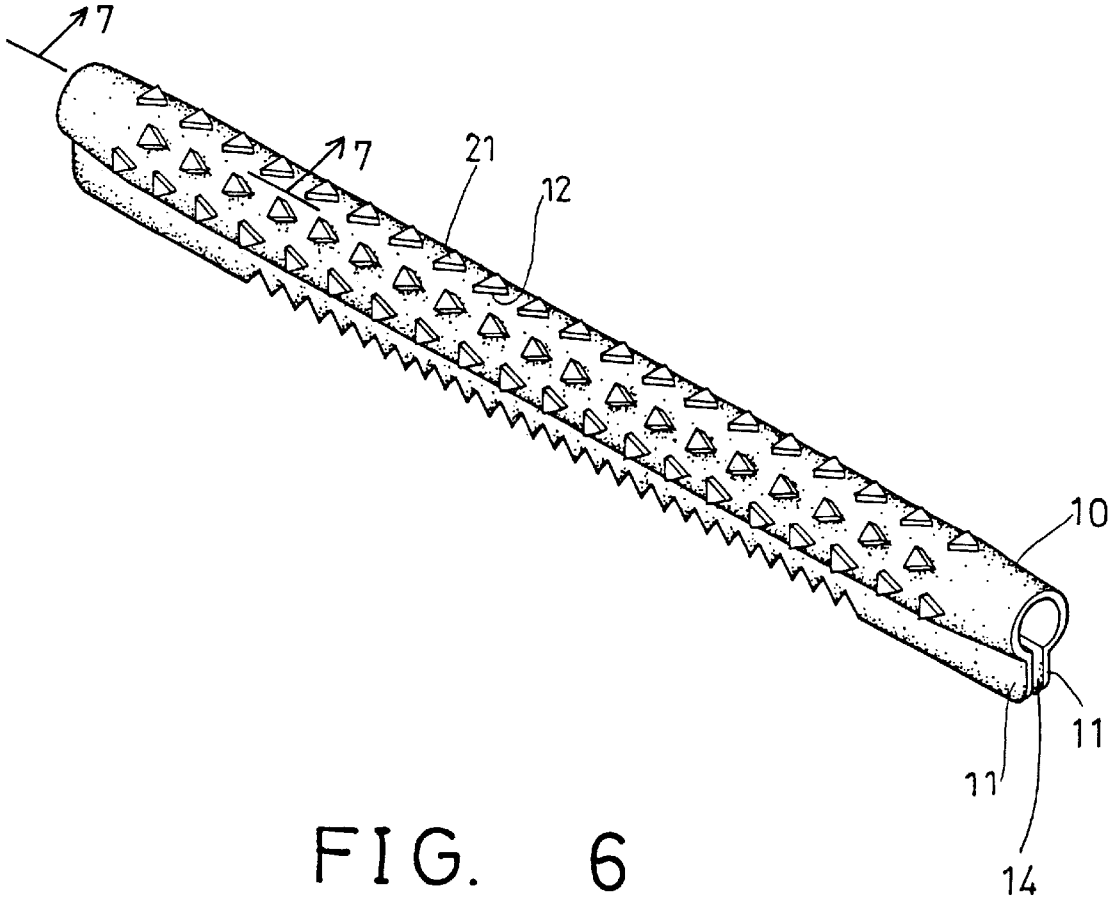
Figure 7:
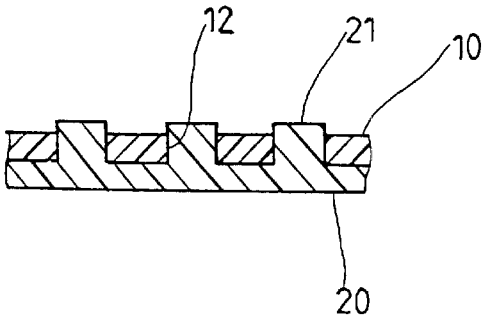

As best shown in FIG. 3, the projections 21 of the tubular insert 20 have a height or a thickness equal to the depths of the orifices 12 of the tubular body member 10 (FIGS. 2, 3), or smaller than the depths of the orifices 12 of the tubular body member 10 (FIGS. 4, 5), or greater than the depths of the orifices 12 of the tubular body member 10 (FIGS. 6, 7). The tubular body member 10 and/or the tubular insert 20, and/or the projections 21 of the tubular insert 20 may be formed with various kinds of colors for decorative purposes. For example, the tubular body member 10 may be made of transparent or semitransparent materials, and the tubular insert 20 may be made of colored materials, such as red, material, which may be seen through the tubular insert 20.

It is preferable that the protective strap is made or rubber material or the other soft or resilient materials for cushioning purposes and for absorbing the shocks transmitted to the suitcase, and for protecting the suitcase and for preventing the suitcase from being damaged by the other objects.

Accordingly, the protective strap in accordance with the present invention may be used for attaching to and for protecting the peripheral portion of the suitcase or the like and for preventing the peripheral portions and/or the corner areas of the suitcase from being damaged by the other objects.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A protective strap for a suitcase, said protective strap comprising;

a body member for attaching onto the suitcase, said body member including a bore formed therein and including an outer peripheral portion having a plurality of orifices formed therein and communicating with said bore of said body, and said body member including a longitudinal portion having a pair of longitudinal flaps extended laterally therefrom for securing to the suitcase, and said body member including a channel defined between said longitudinal flaps and communicating with said bore of said body member, an insert received in said bore of said body member, said insert including a plurality of projections extended therefrom and engaged in said orifices of said body member.

2. The protective strap according to claim 1, wherein said orifices of said body member include a depth equal to a thickness of said projections of said insert.

3. The protective strap according to claim 1, wherein said projections of said insert include a shape corresponding to that of said orifices of said body member for engaging into said orifices of said body member.

4. The protective strap according to claim 1, wherein said longitudinal flaps of said body member each includes a plurality of teeth formed therein.

* * * * *